US009686847B2

(12) United States Patent
Holbeche

(10) Patent No.: US 9,686,847 B2
(45) Date of Patent: Jun. 20, 2017

(54) NOZZLE FOR A PLASMA GENERATION DEVICE

(71) Applicant: LINDE AKTIENGESELLSCHAFT, Munich (DE)

(72) Inventor: Thomas Bickford Holbeche, Church Crookham (GB)

(73) Assignee: Linde Aktiengesellschaft, Munich (DE)

( * ) Notice: Subject to any disclaimer, the term of this patent is extended or adjusted under 35 U.S.C. 154(b) by 0 days.

(21) Appl. No.: 15/112,438

(22) PCT Filed: Jan. 22, 2015

(86) PCT No.: PCT/GB2015/000018
§ 371 (c)(1),
(2) Date: Jul. 19, 2016

(87) PCT Pub. No.: WO2015/110787
PCT Pub. Date: Jul. 30, 2015

(65) Prior Publication Data

US 2016/0338184 A1 Nov. 17, 2016

(30) Foreign Application Priority Data

Jan. 23, 2014 (GB) ..... 1401137.3

(51) Int. Cl.
*H05H 1/24* (2006.01)

(52) U.S. Cl.
CPC ..... *H05H 1/2406* (2013.01); *H05H 2001/245* (2013.01); *H05H 2001/2431* (2013.01); *H05H 2001/2443* (2013.01); *H05H 2001/2456* (2013.01); *H05H 2277/10* (2013.01)

(58) Field of Classification Search
CPC ..... H05H 2001/245; H05H 2001/2456; H05H 2277/10; H05H 1/2406
See application file for complete search history.

(56) References Cited

U.S. PATENT DOCUMENTS

| | | | | |
|---|---|---|---|---|
| 5,970,993 | A | 10/1999 | Witherspoon et al. | |
| 2007/0029500 | A1 | 2/2007 | Coulombe et al. | |
| 2010/0125267 | A1* | 5/2010 | Lee | A61B 18/042 606/27 |
| 2012/0107761 | A1 | 5/2012 | Holbeche et al. | |
| 2013/0147340 | A1 | 6/2013 | Holbeche | |

FOREIGN PATENT DOCUMENTS

| | | | |
|---|---|---|---|
| JP | 2013131311488 | A | 7/2013 |

* cited by examiner

*Primary Examiner* — Tracie Y Green
(74) *Attorney, Agent, or Firm* — David A. Hey, Esq.

(57) ABSTRACT

A nozzle for a plasma generator having a body defining a plasma generating chamber with a gas inlet at one end and a plasma outlet at the opposite end defining the flow direction from the inlet to the outlet. An inner electrode is positioned around an inner wall of the body and an outer earthed electrode is provided around an outer wall of the body. The inner electrode and the outer electrode overlap one another in the flow direction.

17 Claims, 5 Drawing Sheets

NOZZLE FOR A PLASMA GENERATION DEVICE

The present invention relates to a nozzle for a plasma generation device.

Recently a number of proposals have been put forward to provide a system for the generation of non-thermal (also known as non-equilibrium) gas plasma in the industrial, dental, medical, cosmetic and veterinary fields. Non-thermal gas plasma generation can be employed to promote coagulation of blood, cleaning, sterilisation, removal of contaminants from a surface, disinfection, re-connection of tissue and treatment of tissue disorders without causing significant thermal tissue damage. The plasma itself may be applied to a surface to be treated or may act as a precursor of a reactor for a modified gaseous species that is applied to the surface.

One of the key requirements for the uptake of such a device is that it has relatively low power consumption so that it can be made of a size that can be readily used in a domestic or in-surgery environment.

As a result of this, the system should be as efficient as possible. The present invention is directed to a design of the plasma generation nozzle which allows improved efficiency of plasma generation.

WO2010/103262 discloses an arrangement in which an electrode protrudes into the centre of a plasma chamber, the inner wall of which provides the second electrode. US2009/0121637 discloses an arrangement in which a pair of ring electrodes spaced along the chamber with the upstream electrode is provided in the centre of the chamber.

In gas reaction kinetics, the reactions to produce radicals, metastables etc. occur in the gas phase. They are removed by a further reaction both in the gas phase and at the surface. Often, the efficiency of the removal of the surface is very high, so a good way of reducing surface losses is to reduce the surface to volume ratio.

A specific problem which arises with making such a device suitable as a handheld device is that soon as a person holds the device or even places a hand near it even, the electrical field surrounding the plasma chamber (which extends into the atmosphere radially for 100-150 mm) is distorted by the proximity of a strong earth field created by a person's hand or other conducting object. The downstream discharge is thus easily affected by touching the delivery tube, because it provides a localised earth upstream of the plume delivery area. The secondary discharge current flows to that point because it is a lower resistance path. This low current downstream is in direct proportion to the relative resistances of the two paths (upstream and downstream discharges). This has the effect of making the atmospheric extending plume cease to form and become internalised and intensified within the chamber only, the plume is extinguished because the current flowing further downstream is too small to sustain the necessary conducting path through to the exit.

According to the present invention there is provided a nozzle for a plasma generator, the nozzle comprising a body having a gas inlet at one end and plasma outlet at the opposite end defining a flow direction from the inlet to the outlet, and defining a plasma generating chamber, an inner electrode positioned around an inner wall of the body and an outer earthed electrode provided around an outer wall of the body, the inner and outer electrodes overlapping one another in the flow direction.

With such an arrangement, the plasma is generated between the electrodes but the inner electrode does not protrude into the plasma chamber as it extends around the wall. The effect of this is to reduce the surface area and hence the associated surface losses.

A further factor in nozzle design which would make it suitable for new applications is the ease and hence the cost of manufacture. The design of the present invention is well adapted to a simple manufacture as there is no need to support an electrode which protrudes into the chamber.

By placing an earth electrode around the plasma chamber a slight performance decrease in plume length is created, with a slight rise in temperature. However, as this shields the capacitive and conductive effects of a hand or other conductive object, this is a desirable trade off.

Each electrode may extend around only part of the respective wall of the body. For example, each electrode may extend around less than 50% of the circumference of the respective wall. The inner electrode may be on one side of the chamber and the outer electrode may be at the opposite side of the chamber.

However, alternatively each electrode may extend around substantially all of the circumference of the chamber. In this case, a substantial portion of the circumference might be defined as being greater than 70%, more preferably greater than 80% and most preferably greater than 90% of the circumference of the chamber. By increasing the surface area of the electrodes, the field strength is proportionally increased.

Any amount of overlap between the inner and outer electrodes will improve the field strength. However, preferably at least 80% and more preferably 90% of the length of one electrode, is overlapped by the other electrode (if one electrode is larger than the other, the 80% and 90% figure applies to the proportion of the length of the larger electrode that is overlapped, if they are the same length the percentages apply to the length of either electrode). Ideally, both electrodes are the same length and there is 100% overlap.

Although it may have other uses, the nozzle is preferably one which is suitable for treating the human body. In particular, it is preferably capable of generating a non thermal plasma. Such a plasma is preferably emitted at less than 50° C. and more preferably at 25-40%. The device is preferably capable of generating a tissue tolerant plasma.

Preferably the nozzle is a handheld device. In this case, the nozzle preferably further comprises a battery and a transformer connecting the battery to the electrodes.

Preferably, the nozzle is capable of operating at a frequency of 25-50 KHz.

Preferably, the thickness of the electrodes is less than 0.2 mm.

The electrodes may have a solid block structure. However, greater efficacy is achieved using a labyrinthine construction which zig-zags along the length of the body.

Preferably a gas supply subassembly is received in and seals with one end of the body. This provides a simple construction and simple manufacturing technique in that the connection can simply be made at one end of the body which is then sealed allowing the rest of the body to remain free from any interfaces. In order to enhance this, preferably an electrical connection for the inner electrode passes though the sealed interface between the gas supply subassembly and the body.

The inner electrode may be fixed to the inner wall of the body. However, preferably, the inner electrode is in the form of a rolled sheet, the resilience of which causes it to expand into position around the inner wall.

In addition plasma generation can be further promoted if the metastables that are formed in the plasma chamber region are efficiently mixed with fresh gas entering the nozzle.

Preferably, therefore, the gas inlet has a cross sectional area measured perpendicular to a main axis of the nozzle which is less than 20% of the cross sectional area of the chamber immediately downstream of the inlet and measured in a parallel plane. The effect of this is to increase the velocity of the incoming gas. It will also reduce the pressure in the inlet region such that the plasma formation will take place with greater ease. The gas inlet may take a form of a single central orifice or it may be a plurality of orifices at the inlet end (in this case the cross sectional area of the inlet is the total area of all the inlets). Alternatively one or more annular orifices may be arranged around the axis.

It is advantageous to have a reasonably high residence time in the nozzle to allow for more time for the homogenisation of the plasma to form a higher number of metastables which are more evenly distributed from the exit of the nozzle as a jet. However, this increases the opportunity for air to diffuse back into the discharge chamber through the plasma outlet. Preferably, therefore, the chamber tapers towards the plasma outlet. This allows a wider bore size in the vicinity of the electrodes to promote efficient plasma generation, while the taper towards the outlet end ensures a high exit velocity for the outlet gas thereby inhibiting the diffusion of air back into the plasma outlet.

The present invention also extends to a method of assembling the nozzle, the method comprising inserting an inner electrode into the body to be in close proximity with an inner wall of the body, closing an open end of the body with a component containing the gas inlet and positioning the outer electrode around the outside of the body.

Nozzles in accordance with the present invention will now be described with reference to the accompanying drawings, in which.

The present invention relates to a nozzle for plasma-generation device. That is, the device is designed to produce a plasma from the ionisation of a gas. The device is especially for producing a non-thermal plasma. The plasma produced preferably has a temperature of less than 5.0° C., more preferably less than 45° C. and most preferably from 37 to 42° C. It will be appreciated that for certain treatments, especially for hair treatment, temperature may be at even higher temperatures. The device is suitable for applying plasma to a human body, which applies a number of constraints since thermal plasma production devices are clearly unsuitable. Furthermore, the production levels of UV, electrical stimulation and active species must be at levels which do not cause undue harm to a patient.

The device described herein is hand-held. By hand-held, it is meant that at least the treatment application head is sized and configured such that it can be readily manipulated and controlled with one hand. Examples of hand-held devices include hair-brushes, hair-driers, hair-tongs, toothbrushes and the like. The treatment application head described below is tethered to a power supply and a gas reservoir.

The ideal form for home use by a consumer is an entirely self-contained hand held device. This would have an internal battery as a power source and rely upon interchangeable gas canisters which can be clipped into the device. Nonetheless, for reasons of power requirements, it may be easier to have a mains power lead attached to the device.

Especially when the device is to be used by a professional, such as in a hair or nail salon, it may be easier to have the hand-held device tethered to a power supply and a larger gas tank. This makes it easier for the professional to use since they do not need to change the gas tank/cartridge/canister often.

Preferably the power supply comprises a battery integrated into the hand-held device. That is, preferably the plasma-generation device is entirely independent and does not require a tether to a power supply. This increases the utility of the device in-so-far as it can be more accurately applied and can be used in a wider range of environments, such as bathrooms.

It will be understood that if the gas supply and power source are contained within the device, the connections to the nozzle will be as described, the only difference will be that the external connection lines as described will not be present, but instead the connections will be made with the gas supply and power source contained in the device.

Figure 1:
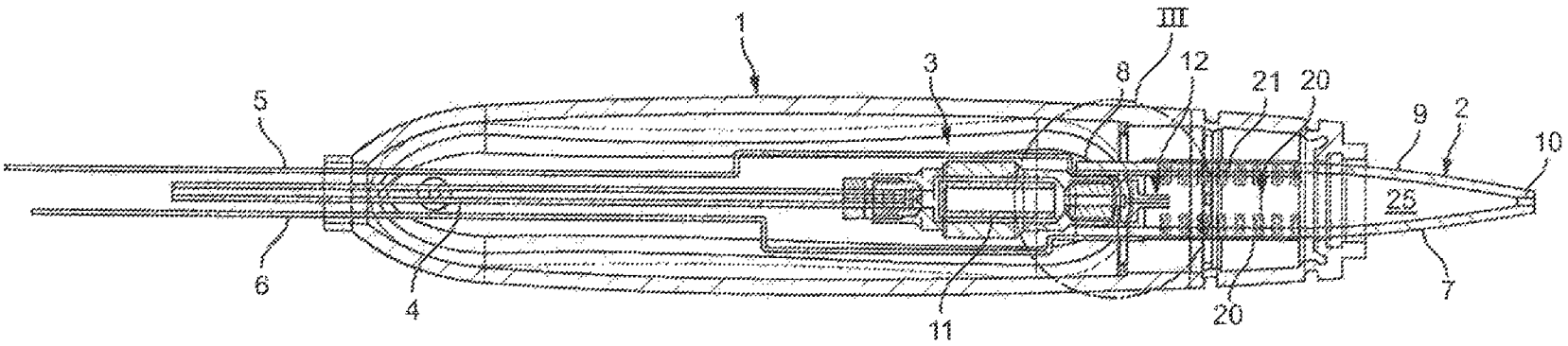
FIG. 1 is a cross-sectional view of a first nozzle shown within a housing and also showing the gas and electrical connections.
Figure 2:
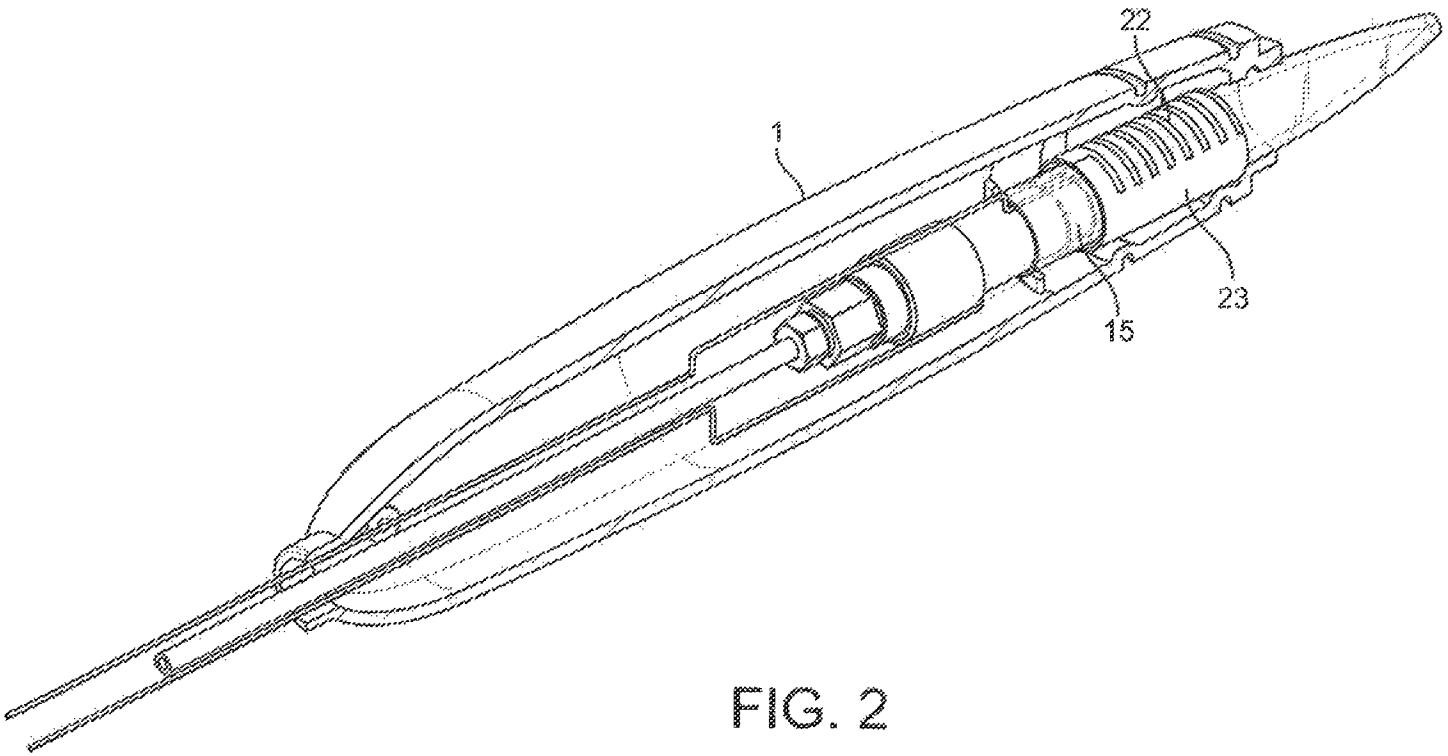
FIG. 2 is a cutaway perspective view from the rear showing similar components to those in FIG. 1.

As shown in FIGS. 1 and 2, the device comprises a casing 1 containing the majority of the components. In general terms, the device further comprises a nozzle 2 at a distal end as described in greater detail below. The nozzle is supplied with a gas via a gas subassembly 3 connected to a gas supply duct 4 which connects to an external gas supply line (not shown). A high voltage electrical connection 5 and an earth connection 6 are connected to the nozzle 2 as described below.

The casing 1 is designed to be held by the user who will either be a consumer or a professional using a treatment device to treat a patient or a customer. The casing 1 may be provided with one or more control buttons (not shown) to control the supply of gas and the power supply.

Alternatively, these can be controlled by external control means.

Figure 3:
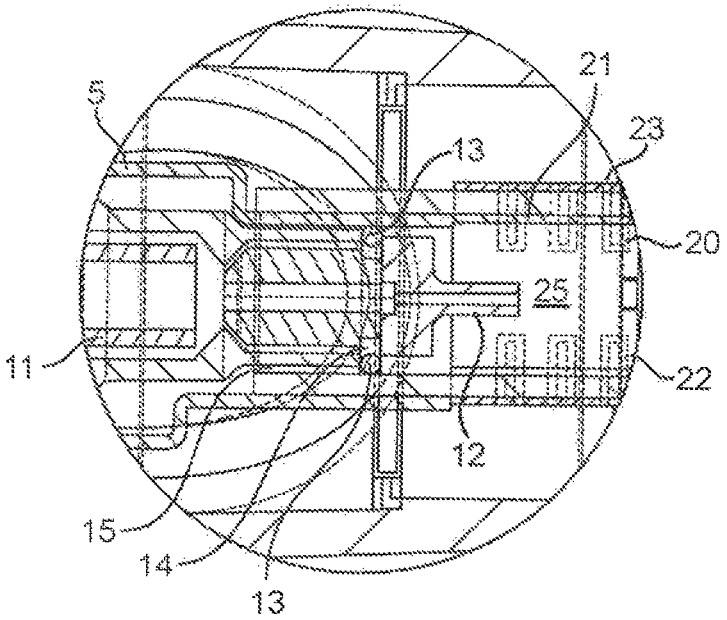
FIG. 3 is a detail of the region marked III in FIG. 1.

The present invention is concerned, in particular, with the design of the nozzle 2. The nozzle 2 has a body in the form of a quartz housing 7. This has a generally cylindrical portion 8 at its proximal end leading to a tapered portion 9 which terminates with a plasma outlet 10. As can be seen in FIG. 1, approximately half of the housing 7 is the cylindrical portion 8 with the other half being the tapered portion 9 which has a gentle curved taper down to the plasma outlet 10. The housing 7 is open at the proximal end to receive a gas supply subassembly 3. The gas supply subassembly 3 has the gas supply duct 4 connected to its proximal end. This leads via a sintered filter element 11 which prevents any debris from entering the gas supply and also stops back formation of the plasma. The gas supply subassembly 3 terminates at gas supply nozzle gas inlet 12 and is sealed within the cylindrical portion 8 of the housing 7 by an O-ring seal 13 as best shown in FIG. 3. The high voltage connection 5 passes over the O-ring seal which, at the point that it passes the O-ring seal presses the seal into an annular groove 14 surrounding the gas supply subassembly as shown in the top portion of FIG. 3. In order to complete the sealing of the proximal end of the casing 1, a potting material 15 such as a silicon sealant is filled into the gap between the casing 1 and the gas supply subassembly 3 which, in this region, has a hexagonal configuration such that once set, will not rotate with respect to the nozzle.

The nozzle 2 is further provided with an inner electrode 20 which is formed on a dielectric sheet 21. This electrode is formed using flexible semiconductor techniques. A flexible polyimide layer is printed with a metallic track forming the electrode. This preferably has a tortuous configuration to provide increased field effects. The metal electrode is then covered with a second flexible polyimide layer to complete the sheet 21 so that the electrode is fully enclosed. This sheet is then attached to the high voltage electrical connection 5 and is then rolled up and placed into the cylindrical portion 8 of the nozzle 2 whereupon the resilience of the sheet causes it to expand into close engagement with the inner wall of the cylindrical portion. Adhesive may be applied to attach the sheet 21 to the inner wall if necessary. Once this is in place, the gas supply subassembly can be attached as described above.

The outer electrode 22 is formed on a dielectric sheet 23 in the same manner as the inner electrode described above. The sheet 23 is wrapped around and adhered to an outer surface of the cylindrical portion 8 of the nozzle 2. Inner electrode 20 is positioned generally diametrically opposite to the outer electrode 22, although some slight deviation from a truly opposite configuration is possible.

In use, the high voltage electrical supply is supplied to the inner electrode 20 while the outer electrode 22 is earthed. Gas is then injected through the gas inlet 12 to generate the plasma. As shown in FIG. 3, the diameter of the gas outlet 12 is significantly smaller than the cross-sectional area of the plasma chamber 25 which increases the velocity of the incoming gas and reduces the pressure in the region of the inlet such that plasma formation will take place with greater ease.

As best seen in FIG. 1, the plasma chamber 25 is free of protruding electrodes thereby reducing the surface area to which the plasma is exposed and hence the associated surface losses. However, the tapering of the plasma nozzle towards the plasma outlet 10 which has the effect of accelerating the gas towards the plasma outlet and reducing the back diffusion of air into the nozzle.

Having the inner electrode 20 on the inner surface of the chamber 25 means that the gas is presented as close to the dielectric covering the electrode 20 as possible thus maximizing the field strength the gas is exposed to an plasma is formed more easily at lower voltages. Having the earth electrode 22 around the outside of the plasma chamber 25 means that the field strength is enhanced further and also the stray capacitance effects are kept to a minimum because the high capacitance formed by the relative closeness of the electrodes with each other negates the capacitance effects of conductive objects brought near the device. This is useful, for example, in a hand held device where the stray capacitance effect is most noticeable when picking up the device. The plume may disappear due to changes in the capacitance as the hand is conductive and therefore changes the field in plasma chamber.

An example of a handheld device incorporating the nozzle according to the present invention will now be described with reference to FIGS. 4 and 5.

The nozzle has the same basic shape and construction in terms of the arrangement of electrodes and gas supply path as described in relation to FIGS. 1 to 3 and the same reference numerals have been used to designate the same components. Details of the shape of certain aspects of the nozzle, for example the gas inlet are different as will be appreciated from the drawings. However, the nozzle shown here is interchangeable with the nozzle of FIG. 1.

Figure 4:
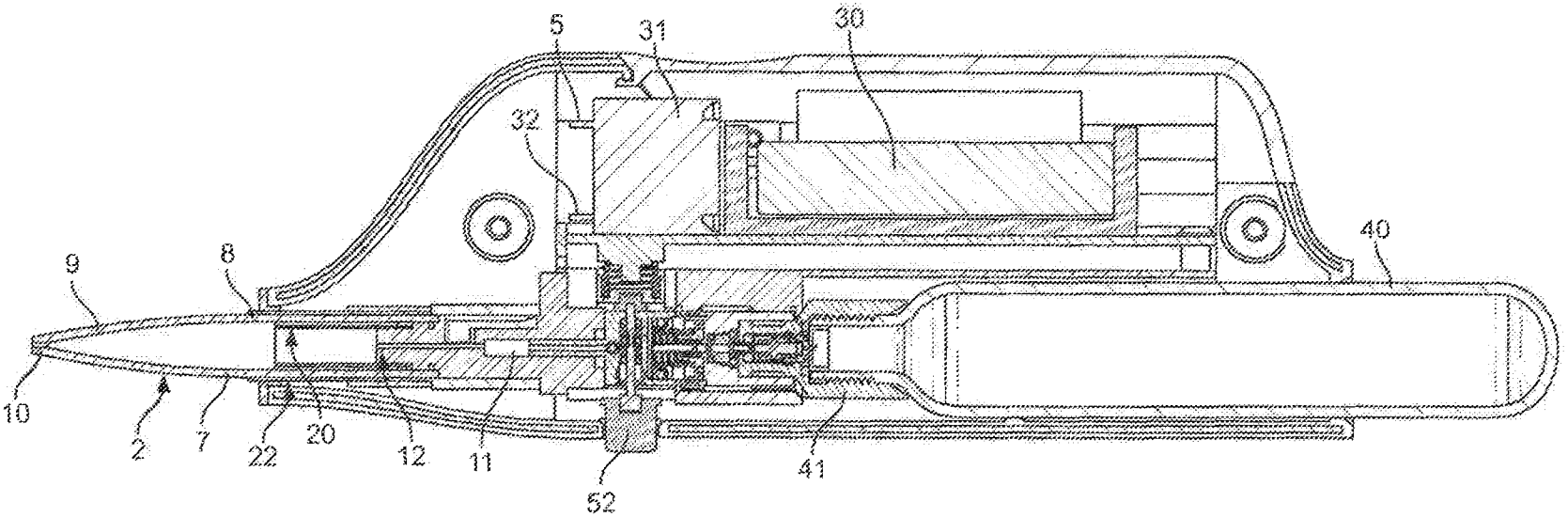
FIG. 4 is a cross-sectional view of a handheld device incorporating a second design of nozzle as well as a gas and power supply.

In FIG. 4, the device incorporates the various other components to make the device a standalone handheld device. In particular, the device additionally comprises a battery 30 which is a lithium battery. This is connected to a high voltage transformer 31 which has the high voltage connection 5 and an earth connection 32. These are provided with leads (not shown) to connect them respectively to the high voltage inner electrode 20 and outer earthed electrode 22.

The device is designed to be used with replaceable gas canisters 40. These are cylinders filled with gas at a pressure of 190 bar. At the outlet end of the cylinder is a cylinder head interface 41 screwed onto the cylinder by a screw thread 42 as best shown in FIG. 5.

The neck of the cylinder is sealed by a foil 43. The cylinder 40 is inserted into the device from the right hand side as shown in FIG. 4. The cylinder head interface 41 enters a bore 44 in the housing and a pin 45 within the housing pushes on a plunger 46 within the cylinder head interface 41 thereby causing a spike 47 in the cylinder head interface 41 to pierce the foil 43 releasing the gas from the cylinder. This opens up the gas supply path around the plunger 46.

This high pressure gas flows to a gas regulator 48 in the form of a narrow orifice 49, the flow through which is controlled by a spring loaded pin 50.

Figure 5:
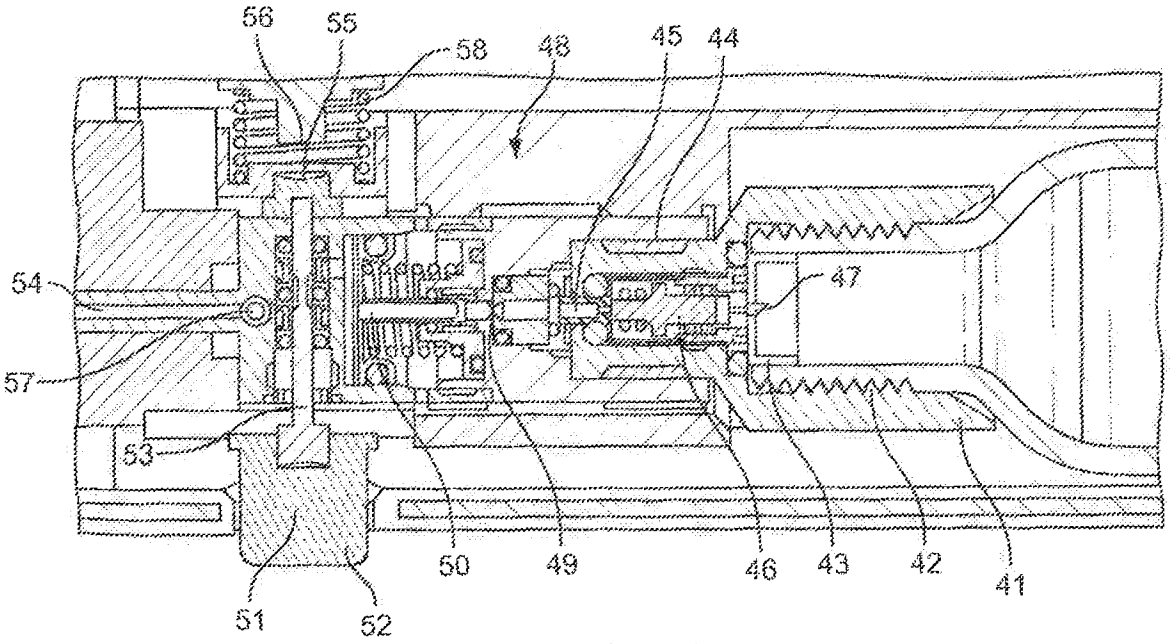
FIG. 5 is a close up view of a portion of FIG. 4 showing the gas path into the nozzle.

As best shown in FIG. 5, the gas flow path is blocked by control valve 51. This has a button 52 connected to a stem 53 which normally closes the gas flow path. Manual depression of the button 52 by a user opens the gas flow path 54 to allow the regulated gas to pass into the nozzle 2. At the same time, the depression of the button 52 makes up an electrical contact between two electrical contacts 55, 56 on the valve 51 and transformer 31 respectively to supply power across the electrodes 20, 22.

A flow control valve 57 is connected to an externally manipulatable button in order to allow a manufacturer or user to set the gas flow rate. On release of the button 51, a return spring 58 causes the button to be returned to its starting position thereby cutting off the gas and electrical supplies.

When the gas in that cylinder is exhausted, the cylinder 40 can simply be pulled out and a new one can be pushed into place. If the cylinder is pulled out before the gas is fully depleted, the gas pressure will act against the plunger 46 thereby sealing the cylinder to prevent unwanted gas discharge in the event of its premature removal.

The invention claimed is:

1. A nozzle for plasma generator, suitable for treating the human body, the nozzle comprising a body having a gas inlet at one end and plasma outlet at the opposite end, and defining a flow direction from the inlet to the outlet, and defining a plasma generating chamber, an inner electrode positioned around part of an inner wall of the body, the inner electrode not protruding into the plasma generating chamber and an outer earthed electrode provided around part of an outer wall of the body, the inner and outer electrodes overlapping one another in the flow direction.

2. A nozzle according to claim 1, wherein the inner and outer electrodes extend around substantially all of the circumference of the chamber.

3. A nozzle according to claim 1, wherein the inner and outer electrodes each extend around part of the respective wall and are at opposite sides of the chamber.

4. A nozzle according to claim 1, suitable for generating a non-thermal plasma.

5. A nozzle according to claim 4, arranged to emit the plasma at less than 50° C.

6. A nozzle according to claim 1, suitable for generating a tissue tolerant plasma.

7. A nozzle according to claim 1, the nozzle being a handheld device.

8. A nozzle according to claim 7, wherein the handheld device includes a battery and a transformer connecting the battery to the electrodes.

9. A nozzle according to claim 1, wherein the inner electrode is supplied with power at a frequency of 25-50 KHz.

10. A nozzle according to claim 1, wherein the electrodes are provided on a substrate with a thickness less than 0.2 mm.

11. A nozzle according to claim 1, wherein the electrode have a labyrinthine construction which zig-zags along the length of the body.

12. A nozzle according to claim 1, wherein a gas supply subassembly is received in and seals with one end of the body.

13. A nozzle according to claim 12, wherein an electrical connection for the inner electrode passes through the sealed interface between the gas supply subassembly and the body.

14. A nozzle for a plasma generator, the nozzle comprising a body having a gas inlet at one end and plasma outlet at the opposite end, and defining a flow direction from the inlet to the outlet, and defining a plasma generating chamber, an inner electrode positioned around part of an inner wall of the body and an outer earthed electrode provided around part of an outer wall of the body, the inner and outer electrodes overlapping one another in the flow direction; wherein the inner electrode is in the form of a rolled sheet, the resilience of which causes it to expand into position around the inner wall.

15. A nozzle according to claim 1, wherein the gas inlet has a cross sectional area measured perpendicular to a main axis of the nozzle which is less than 20% of the cross sectional area of the chamber immediately downstream of the inlet and measured in a parallel plane.

16. A nozzle according to claim 1, wherein the chamber tapers towards the plasma outlet.

17. A method of forming a nozzle for a plasma generator, the nozzle comprising a body having a gas inlet at one end and a plasma outlet at the opposite end, defining a flow direction from the inlet to the outlet and defining a plasma generating chamber, an inner electrode positioned around part of an inner wall of the body, the inner electrode not protruding into the plasma generating chamber and an outer earthed electrode provided around part of an outer wall of the body, the inner and outer electrodes overlapping one another in the flow direction;

the method comprising inserting the inner electrode into the body to be in close proximity with the inner wall of the body, closing an open end of the body with a component containing the gas inlet and positioning the outer electrode around the outside of the body.

* * * * *